US008127577B2

(12) United States Patent
Buhl et al.

(10) Patent No.: US 8,127,577 B2
(45) Date of Patent: Mar. 6, 2012

(54) LOCK

(75) Inventors: Joachim Buhl, Salzburg (DE); Friedhelm Schell, Niederroβbach (DE); Martin Hommel, Rehe (DE); Thomas Becker, Hilnfelden (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 786 days.

(21) Appl. No.: 12/179,939

(22) Filed: Jul. 25, 2008

(65) Prior Publication Data

US 2009/0049875 A1 Feb. 26, 2009

(30) Foreign Application Priority Data

Jul. 27, 2007 (DE) ..... 10 2007 035 122

(51) Int. Cl.
*E05B 67/06* (2006.01)
*E05B 67/22* (2006.01)
*E05B 67/24* (2006.01)

(52) U.S. Cl. ..... 70/38 A; 70/38 B; 70/38 C; 70/38 R; 70/39; 70/416; 70/417; 70/419; 70/422

(58) Field of Classification Search ..... 70/38 A, 70/38 B, 38 C, 38 R, 39, 416, 417, 419, 422
See application file for complete search history.

(56) References Cited

U.S. PATENT DOCUMENTS 4,231,244 A 11/1980 Krugener et al.
5,189,893 A 3/1993 Kortenbrede et al.
5,417,092 A * 5/1995 Iu ..... 70/38 A
5,839,302 A * 11/1998 Chu ..... 70/38 A
5,950,461 A * 9/1999 Tsai ..... 70/38 A
5,987,940 A * 11/1999 Chang ..... 70/38 A
6,430,975 B1 * 8/2002 McDaid ..... 70/39
6,718,802 B2 * 4/2004 Vito ..... 70/18
7,665,333 B2 * 2/2010 Shabtay et al. ..... 70/38 A
7,823,424 B2 * 11/2010 Shabtay et al. ..... 70/38 A

FOREIGN PATENT DOCUMENTS

DE 1939011 2/1972

(Continued)

OTHER PUBLICATIONS

European Search Report dated Dec. 9, 2010 EP No. 08013268.1.
German Search Report dated Jul. 18, 2008. DE 10 2007 035 122.6.

*Primary Examiner* — Lloyd Gall
*Assistant Examiner* — David E Sosnowski
(74) *Attorney, Agent, or Firm* — Gifford, Krass, Sprinkle, Anderson & Citkowski, P.C.

(57) ABSTRACT

The invention relates to a lock, in particular a hoop lock, having a lock housing, in which a locking cylinder of the lock is arranged, including a cylinder housing, a barrel rotatably mounted in the cylinder housing and a driver unit associated in a drive effective manner with the barrel, and having at least one bolt coupled to the barrel via the driver unit, so that by rotating the barrel the at least one bolt is moveable from a locked position into a release position. The lock housing has a receiving space in an axial extension of the locking cylinder, with the locking cylinder or a part thereof being able to be displaced from an operational position into the receiving space on the application of a predefined force in the axial direction of the locking cylinder, to adopt a sabotage position, in which the coupling of the at least one bolt to the barrel is taken out of operation.

24 Claims, 2 Drawing Sheets

FOREIGN PATENT DOCUMENTS

| | | | |
|---|---|---|---|
| DE | 27 48 408 | A1 | 5/1979 |
| DE | 90 13 187.8 | | 5/1991 |
| DE | 102005043926 | | 3/2007 |
| EP | 0831198 | | 3/1998 |
| GB | 2 141 170 | | 12/1984 |
| WO | WO-2004/109044 | | 12/2004 |

* cited by examiner

LOCK

BACKGROUND OF THE INVENTION

1. Field of the Invention

The present invention relates to a lock, in particular a hoop lock, having a lock housing, in which a locking cylinder is arranged, including a cylinder housing, a barrel rotatably mounted in the cylinder housing and a driver unit associated in a drive effective manner with the barrel and having at least one bolt coupled to the barrel via the driver unit. Due to a rotation of the barrel in the opening direction the bolt is hereby moveable from a locked position into a release position, in particular through a compulsory guide or in that the bolt is only released for a movement from the locked position into the release position.

2. Description of Related Art

On a forced attempt at breaking open such a lock, for example, a screw-driver is inserted into the key way of the barrel to achieve a jamming of the screwdriver with the barrel. It is then attempted to forcibly rotate the barrel to shear off the pin tumblers of the barrel. It should hereby be achieved to rotate the driver unit into the opening direction to ultimately obtain a movement of the bolt from the locked position into the release position.

SUMMARY OF THE PRESENT INVENTION

The underlying object of the invention is to provide a lock of the initially named kind having an increased security against being broken open.

This object is satisfied by a lock having the features of claim 1 and in particular in that the lock housing has a receiving space in an axial extension of the locking cylinder, with the locking cylinder or a part thereof being able to be displaced in the axial direction of the locking cylinder from an operational position into the receiving space on application of a predefined force in the axial direction to adopt a sabotage position in which the coupling of the bolt to the barrel is taken out of operation.

The receiving space intentionally enables the force which is exerted onto the barrel in the axial direction on a forced insertion of a breaking open tool to be used to deliberately allow or cause an axial movement of the locking cylinder or of the part thereof. The locking cylinder or the part thereof is in this respect hereupon transferred from the operational position into the sabotage position in which the effect chain from the rotation of the barrel to the movement of the bolt into the release position is disengaged, i.e. the bolt can no longer be moved any more in the sabotage position.

In previous locks the complete locking cylinder moves in the axial direction on such an attempt at breaking open. If only a part of the locking cylinder is axially moved it can cause the barrel of the locking cylinder to actuate the driver unit.

The driver unit can generally be an integral part of the barrel or be formed separate herefrom. In previous locks the drive effective relationship between the barrel and the driver unit was rotatably fixed in both directions, for example, through a shape matched engagement between the barrel and the driver unit. In this case the driver unit is prestressed in the locking direction; optionally the bolt is prestressed in the direction of the release position and the barrel operates together with the driver unit in the opening direction.

The application of the predefined force is to be understood as an application of force to the locking cylinder and the barrel which is greater than the axially applied force in the normal operation of the lock, i.e. when the lock is operated by the authorized user by means of the associated identification means (i.e. a key). In particular the named application of the predefined force is sufficient to move the locking cylinder or the part thereof from the operational position into the sabotage position.

The longitudinal axis of the locking cylinder is generally to be understood as the axis of rotation of the barrel.

To fix the locking cylinder or the part thereof at least in the axial direction in the operational position on the typical application of force in normal operation, fixing means can be provided which are capable of being overcome through the application of the predefined force by the locking cylinder or of the part thereof.

For example, the fixing means can be formed as at least one fixing lug of the lock housing for the locking cylinder to secure the locking cylinder in the lock housing, which is preferably comprised of zinc die cast or plastic. A fixing can also be achieved through a press fit or a friction fit between the lock housing and the locking cylinder. Alternatively or additionally a wall section can be provided for the barrel, with the wall section being formed at an axial end of the locking cylinder to fix the barrel in the operational position.

The fixing means, in particular the named fixing lug and/or the wall section provided at the axial end of the locking cylinder is/are preferably adapted to break off and/or to break through when the predefined applied force is achieved. The fixing means then serve as desired breaking points which give way on reaching the predefined applied force and permit an axial movement of the locking cylinder or of the part thereof.

Alternatively or additionally to the fixing means, holding means can also be provided which in the operational position, in particular in the region of the receiving space border the bolt and hold, guide and/or support it with the holding means being able to be overcome by the bolt by the application of the predefined force.

The holding means can include at least one holding lug of the lock housing for the bolt. Preferably, if two bolts are present, a separate holding lug is provided for each of the bolts.

The holding means are preferably adapted to break off upon reaching the applied predefined force to enable penetration of the part of the bolt located in the region of the receiving space and/or the locking cylinder.

It is also advantageous if the lock housing includes a retaining means which is adapted to hold the locking cylinder or of the part thereof following the displacement in the sabotage position, i.e. it is ensured that the locking cylinder or the part thereof is no longer retraceable into the operational position in which a drive effective coupling of the bolt to the barrel could be established again under some circumstances.

The retaining means can, for example, be formed as a taper of the cavity of the lock housing into which the locking cylinder is placed in the operational position to obtain a clamping between the locking cylinder and the lock housing on displacing the locking cylinder into the sabotage position. Basically it is preferred if the locking cylinder takes up a force fit in the lock housing in the sabotage position.

In accordance with an embodiment of the invention the lock includes fixing means which, in the sabotage position of the locking cylinder or of the part thereof, prevent the bolt from a movement out of the locked position into the release position, i.e. the movement of the bolt is blocked.

This, for example, can be obtained when, in the sabotage position of the locking cylinder or of the part thereof, by at least one bolt is in operative connection with an abutment portion of the lock housing. The abutment portion is located in the movement track of the bolt to block the bolt in the locked position.

On moving the locking cylinder or of the part thereof the bolt can experience a plastic deformation, i.e. the bolt in the sabotage position of the locking cylinder or of the part thereof has a shape which is plastically deformed with respect to the shape which the at least one bolt has in the operational position of the locking cylinder or of the part thereof. It is hereby in particular made possible to bring the bolt into operative connection with the named abutment portion of the lock housing.

A blocking of the movement of the bolt in the sabotage position can furthermore be obtained in that, in the sabotage position of the locking cylinder or of the part thereof, a blocking section of the locking cylinder prevents the bolt from a movement out of the locked position into the release position. In this case the displacement of the blocking section of the locking cylinder is responsible for the bolt being fixed in the sabotage position of the locking cylinder or of the part thereof and a movement into the release position being blocked. The blocking section of the locking cylinder is preferably an outer section of the cylinder housing of the locking cylinder.

In accordance with another embodiment of the invention, in the sabotage position of the locking cylinder or of the part thereof, at least one coupling section of the driver unit and at least one associated coupling section of the bolt are decoupled from one another. Through the axial displacement of the locking cylinder or of the part thereof the coupling section of the driver unit and the associated coupling section of the bolt can be brought out of engagement to set the drive effective coupling of the bolt with the barrel out of function so that the barrel turns freely with respect to the bolt.

In accordance with yet another embodiment of the invention, in the sabotage position, the drive effective relationship of the driver unit and the barrel is released. This, for example, can be obtained in that the driver unit, which in the operational position is preferably fixedly connected to the rotatable barrel, breaks into two fragments, with the one fragment being connected to the barrel and the other fragment being connected to the bolt. The fragment of the driver unit connected to the barrel is then axially displaced with respect to the fragment of the driver unit connected to the bolt due to the axial displacement of the barrel such that the barrel rotates freely with respect to the bolt. Alternatively a release of the drive effective relationship of the driver unit to the barrel can, however, also be obtained in that the driver unit is made in two parts, with the two parts in the operational position of the barrel engaging drive effectively into one another and in the axial direction engaging releasably into one another and with the one part of the driver unit being rotationally fixedly connected to the barrel and the other part of the driver unit being coupled to the bolt.

The receiving space preferably has a shorter length than the locking cylinder in the direction of the longitudinal axis of the locking cylinder. The locking cylinder or the part thereof in this case only partly dips into the receiving space so that the lock can be realized with a small construction depth in the region of the locking cylinder.

The driver unit can be arranged in the axial extension of the barrel and/or be arranged coaxially to the barrel.

In accordance with an embodiment of the invention at least one bolt is pivotally connected to the driver unit, for example, via a driver cam eccentrically formed at the driver unit. In particular two bolts are provided, with the driver unit then including two eccentrically arranged driver cams to which in each case one of the two bolts is pivotally connected.

In accordance with another embodiment of the invention, in the operational position of the locking cylinder or of the part thereof, the bolt is prestressed in the direction of the driver unit and is in contact with a peripheral contact region of the driver unit which is eccentric with respect to the axis of rotation of the driver unit (for example, elliptical or oval). Through the rotation of the barrel and thus of the driver unit the spacing of the end of the bolt, contacting the driver unit, from the longitudinal axis of the locking cylinder can consequently be changed, whereby a movement of the bolt between the release position and the locked position is made possible.

The direction of movement of the bolt preferably extends perpendicular to the longitudinal axis of the locking cylinder. Basically it is also possible that the bolt typically be formed as a bolt bar has a ring like shape for a rotation about a middle point to be used, for example, in a hanging lock with a rotatable bolt (e.g. model range "Diskus" (registered trade mark) of ABUS August Bremicker Söhne KG).

It is also advantageous if the bolt is formed as a bolt plate at its end facing to the driver unit and/or as a bolt block at its end facing the locking region. The solid bolt block is then provided to engage into a lockable opposing element of the lock to ensure a resistant locking. In the region of the driver unit the bolt does not have to be formed in such a solid manner so that weight can be saved. Furthermore, a bolt plate is more easily deformable laterally whereby the explained establishing of an operative connection between the bolt and the named abutment portion of the lock housing is simplified on axially displacing the locking cylinder or the part thereof.

Further embodiments of the invention are set forth in the subordinate claims, the description and the drawing.

BRIEF DESCRIPTION OF THE DRAWING

The invention will be described in the following only by way of example with reference to the drawings.

They show, in each case in a schematic illustration.

DETAILED DESCRIPTION OF A PREFERRED EMBODIMENT OF THE INVENTION

Figure 1A:
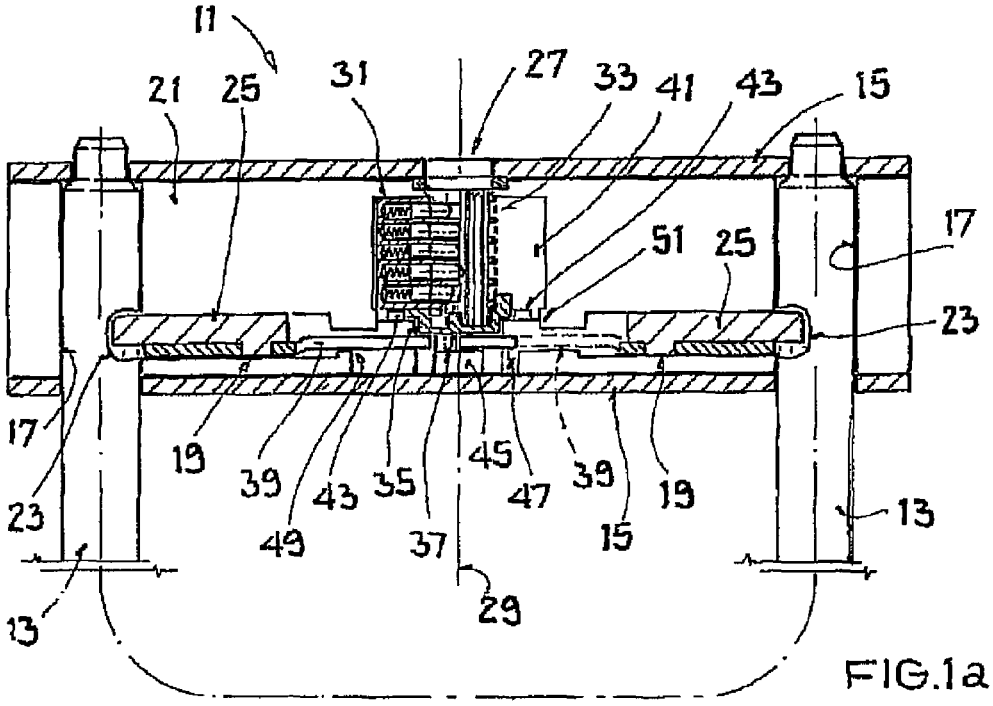
FIG. 1 different views of a hoop lock in accordance with a first embodiment of the invention, FIG. 2 different views of a hoop lock in accordance with a second embodiment of the invention in the region of a locking cylinder, and FIG. 3 a cross-sectional view of a lock in accordance with a third embodiment of the invention in the region of a locking cylinder.
Figure 1B:
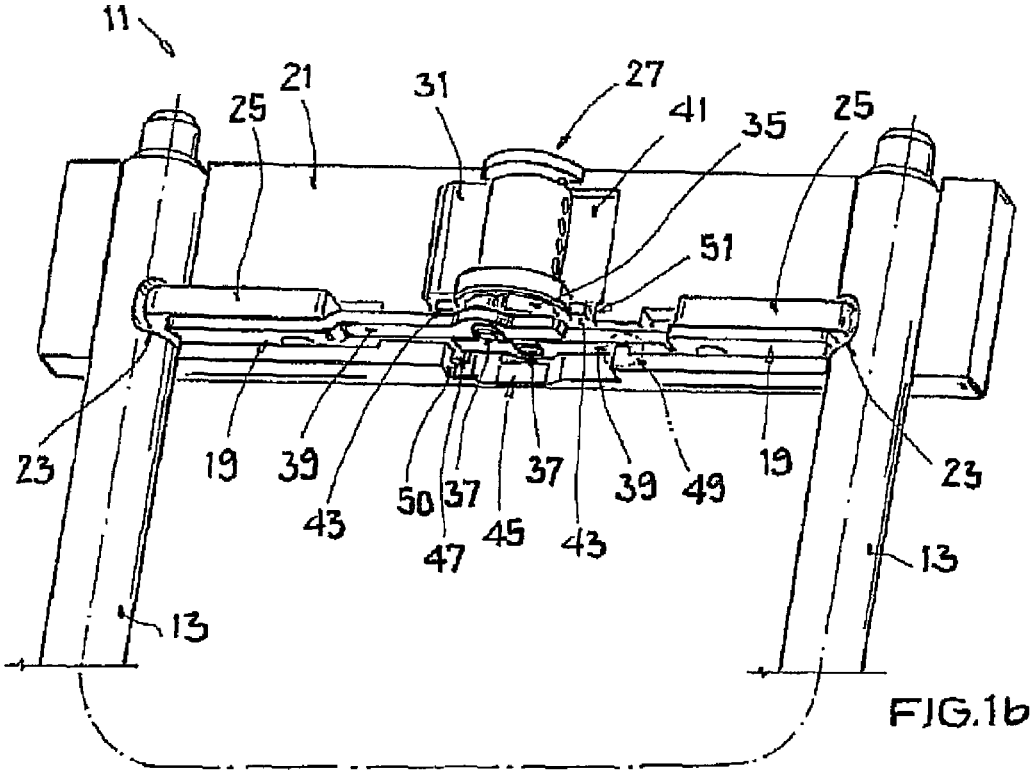

The hoop lock in accordance with the invention illustrated in FIG. 1 has a lock body 11 and a lock hoop 13 attachable to it, which is only shown in the region of its two hoop ends. The hoop lock can, for example, be used to lock up a two wheeler or to secure it to another object, for example to a bike stand. FIG. 1*a* shows a cross sectional illustration of the hoop lock, whereas FIG. 1*b* shows the hoop lock of FIG. 1*a* in a cut open perspective illustration and an outer lock housing 15 shown in FIG. 1*a* is omitted.

In FIG. 1 the hoop lock is illustrated in a locked position in which the two ends of the lock hoop 13 are respectively inserted into an associated hoop end receiver 17 of the lock body 11. For the locking of the lock hoop 13 at the lock body 11 two bolts 19 are provided which are arranged movably in the longitudinal direction in an inner lock housing 21 of the lock body 11 and respectively protrude into one of the two hoop receivers 17. There the bolts 19 engage into the bolt receivers 23 formed at the two ends of the lock hoop 13 to secure the lock hoop 13 against a removal from the lock body 11. The bolts 19 are formed as a solid bolt block 25 at their respective ends with which they engage into the associated bolt receivers 23 of the lock hoop 13 so that a stable locking is realized.

The bolts 19 are movable by means of a locking cylinder 27 arranged centrally in the lock housing 11 in the inner lock housing 21 between the locked position shown in FIG. 1 and a release position (not shown), with the two bolts 19 being retracted out of the bolt receivers 23 of the lock hoop 13 in the release position. The movement direction of the two bolts 19 extends in each case perpendicular to the longitudinal axis 29 of the locking cylinder 27.

The locking cylinder 27 has a cylinder housing 31 and a barrel 33 rotatably mounted in the cylinder housing 31. The barrel 33 is in a rotationally fixed relationship to a driver 35, which is arranged in the axial extension of the barrel 33 and is arranged coaxially to the barrel 33. The driver 35 can be an integral part of the barrel 33 or can be connected in any other way in a rotationally fixed manner (for example by a shape matched engagement) to the barrel 33. Alternatively a so called automatic function can be realized.

The driver 35 has two driver cams 37 which in each case are arranged eccentrically with respect to the longitudinal axis 29 of the locking cylinder 27 at which one of the respective two bolts 19 is pivotally connected, with the bolts 19 in each case being formed as bolt plates 39 at their ends facing to the driver 35. Thus the bolts 19 are in each case coupled drive effectively via the driver 35 to the barrel 33 so that through a rotation of the barrel 33 the bolts 19 are in each case movable between the release position and the locked position.

The locking cylinder 27 is arranged in a locking cylinder receiver 41. At its end facing the bolts 19 the locking cylinder receiver 41 is bounded by two fixing lugs 43 of the inner lock housing 21 to secure the cylinder housing 31 and thus the locking cylinder 27 against an axial movement along the longitudinal axis 29 of the locking cylinder 27 in each of the two possible positions of the locking cylinder 27 in the lock body 11. The fixing lugs 43 in this case act as desired breaking points, i.e. from a reaching of a predefined axial force applied to the locking cylinder 27 onward, such as occurs during an attempted breaking open through hammering in a breaking open tool into the key way of the barrel 33, the fixing lugs 43 break off and release the locking cylinder 27 for an axial movement along the longitudinal axis 29 of the locking cylinder 27.

The axial movement is made possible in that, in an axial extension of the locking cylinder 27, a receiving space 45 is formed within the outer lock housing 15 into which the locking cylinder 27 and above all the bolts 19 pivotally connected to the locking cylinder 27 can dip when the bolt 19 is in the locked position shown. The locking cylinder 27 can thus be displaced from an operational position, as shown in FIG. 1, into a sabotage position (not shown) through overcoming the respective fixing lug 43.

Moreover, besides the two fixing lugs 43, two holding logs are formed at the inner lock housing 21; however, FIG. 1 only shows one holding lug 47. The two holding lugs 47 respectively protrude into the receiving space 45, are in each case associated with the ends of the bolts 19 pivotally connected to the driver 35 and lie neighboring to them, with each of the end of the bolts 19 pivotally connected to the driver 35 ending in the region of the associated holding lug 47 so that a dipping of these ends of the bolts 19 into the receiving space 45 is principally possible due to an axial displacement of the locking cylinder 27 in the direction of the receiving space 45. The holding lugs 47 likewise act as desired breaking points which break off on reaching the predefined axially applied force along the longitudinal axis 29 of the locking cylinder 27 due to the force which is applied by the ends of the bolts 19 pivotally connected to the driver 35.

As a consequence thereof the ends of the bolts 19 can be bent around a respectively associated support section 49 of the lock housing 21 into the receiving space under plastic deformation, with FIG. 1 simply showing a single such support section 49. A clamping connection is hereby created between the respective bolt 19 and the respective support section 49 of the inner lock housing 21 which makes sure that a movement of the respective bolt 19 from the locked position into the release position is at least made difficult. Above all because of the exemplified bending the respective ends of the two bolts 19 are displaced from the plane of movement provided for normal operation in the direction of a respective abutment section 50 of the inner lock housing 21, with in FIG. 1*b* only one of the two abutment sections 50 being shown. Each abutment section 50 is formed through an end face at which the respective holding lug 47 is formed provided it has not yet been broken off. The abutment sections 50 thus serve as abutments for the bolt ends, with them blocking the bolts 19 against a displacement from the locked position into the release position, i.e. the bolts 19 are fixed in the sabotage position of the locking cylinder 27.

To hold the locking cylinder 27 in the sabotage position, the locking cylinder receiver 41 has a taper 51 in the region of its bolt 19. On an axial movement of the locking cylinder 27, it jams in the taper with the taper 51 acting as retaining means to prevent a return of the locking cylinder 27 into the operational position shown in FIG. 1.

The hoop lock in accordance with the invention is therefore constructed in such a way that on a forced attempt at breaking open the locking cylinder 27 is transferred from an operational position into a sabotage position in which a displacement of the bolts 19 into the release position by a forced rotation of the barrel 33 is prevented.

In the following further embodiments of the invention shall be described, with reference to FIGS. 2 and 3 with the same or similar components being provided with the same reference numerals.

Figure 2A:
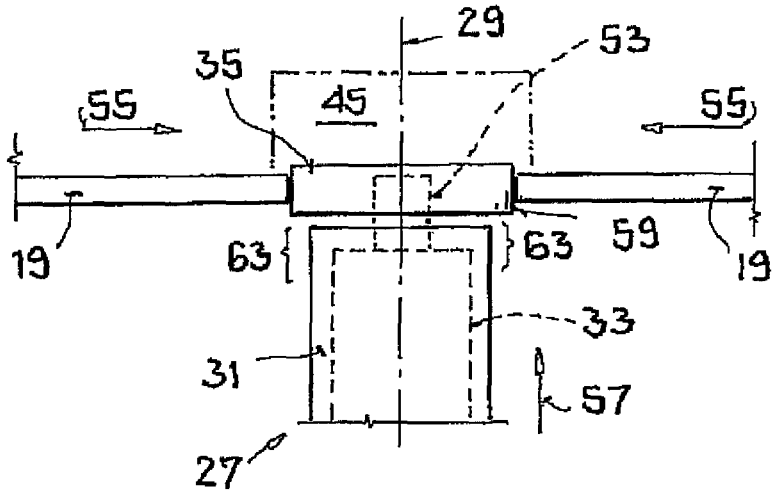
Figure 2B:
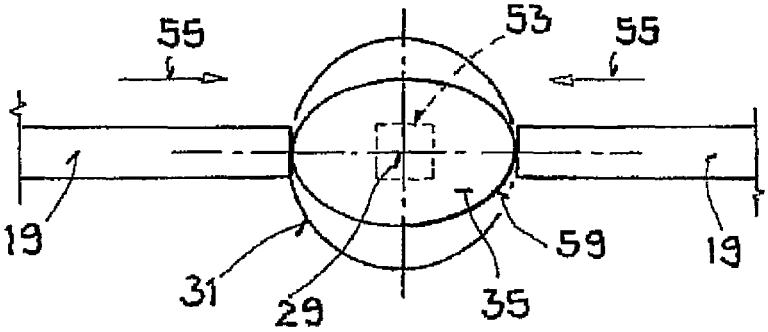

The section of the hoop lock illustrated in FIG. 2*a* in a cross-sectional view and in FIG. 2*b* in a plan view in accordance with the second embodiment of the invention shows a locking cylinder 27 including a cylinder housing 31 and a barrel 33 rotatably mounted therein. A driver 35 of the locking cylinder 27 is rotationally fixedly connected to the barrel 33 via a driver lug 53 of the barrel 33 in axial extension of the barrel 33. The driver 35 has the shape of an oval cylinder as can be recognized in FIG. 2*b*.

Furthermore, two opposing bolts 19 are mutually oppositely disposed with respect to the locking cylinder 27 are provided which in each case are prestressed in the direction of the driver 35 as can be recognized with reference to the arrows 55. In the locked position shown in FIG. 2 the bolts 19 are in contact with a peripheral contact region 59 of the driver 35, with the large half axes of the driver 35 being orientated aligned with the bolt axes 19. To move the bolts 19 into a release position (not shown), the barrel 33 is rotated by 90° about the longitudinal axis 29 of the locking cylinder 27 so that then the small half axes of the driver 35 are orientated aligned with the bolt axes 19.

If an attempt is now made to break open the lock shown in FIG. 2 by applying a predefined force in the axial direction of the locking cylinder 27, the locking cylinder 27 moves together with the driver 35 along a direction of movement 57, which corresponds to the direction of the longitudinal axis 29 of the locking cylinder 27, from the operational position shown in FIG. 2 so far into a receiving space 45 in that the original position of the driver 35 is taken over by the upper end 63 of the cylinder housing 31 of the locking cylinder 27 which defines a blocking section (sabotage position). Since the locking cylinder 27 is formed circularly cylindrically at its upper end 63 and the diameter in the region 63 approximately corresponds to the diameter of the driver 35 in the region of the large half axes, the bolts 19 in the sabotage position also remain unchanged in the locked position shown in FIG. 2. The bolts 19 are, however, decoupled from the driver 35 in the sabotage position.

If the barrel 33 is rotated in the sabotage position, the driver 35 also rotates. However, in the sabotage position the bolts 19 are no longer in contact with the peripheral contact region 59 of the driver 35 but, with the cylinder housing 31 of the locking cylinder 27 so that the bolts 19 remain in their locked position shown in FIG. 2.

Consequently, the circularly cylindrical cylinder housing 31 replaces the oval cylindrical driver 35 in the plane of movement of the bolts 19 so that, independently of the rotation position of the barrel 33, the bolts 19 are blocked against a movement into the release position. The bolts 19 are not deformed in this embodiment of the invention.

Figure 3:
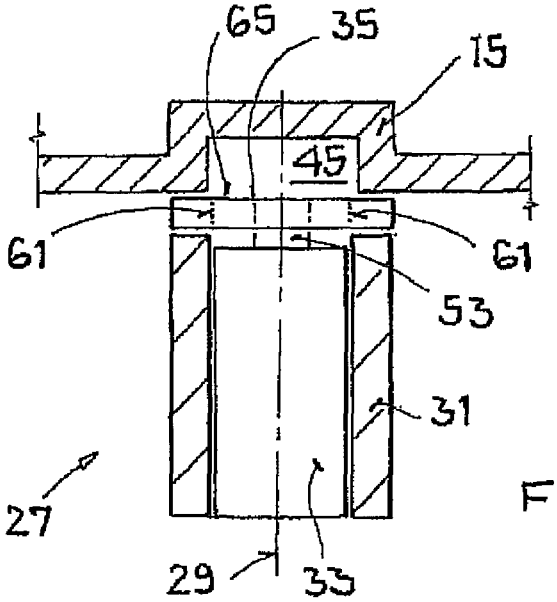

The section of a lock shown in FIG. 3 in accordance with the third embodiment of the invention includes a locking cylinder 27 having a cylinder housing 31 and a barrel 33 rotatably mounted therein. The barrel 33 is rotationally fixedly connected to a driver 35 via a driver lug 53 of the barrel 33. The driver 35 forms an end wall for the barrel 33. A rotation of the barrel 33 results in a corresponding rotation of the driver 35. The driver 35 is laterally coupled to at least one bolt (not shown), with the bolt being movable between a release position and a locked position.

If sufficient force is applied to the barrel 33, shown in FIG. 3 in an operational position, along the longitudinal axis 29 of the locking cylinder 29, the driver 35 breaks through at a circumferential desired breaking point 61 so that the inner part 65 of the driver 35 and an upper end of the barrel 33 can dip into a receiving space arranged in an axial extension of the locking cylinder 27 (sabotage position, not shown). The broken off outer margin of the driver 35 with which the bolt interacts stays in its position between the cylinder housing 31 and a section of an outer lock housing 15. Thus, in the sabotage position the rotationally fixed relationship of the driver to the barrel 33 is disengaged. The mechanism shown in FIG. 3 can, for example, also be used in a hanging lock with a rotatable bolt.

Alternatively it is also possible that the driver is already formed in two parts, with the two parts being rotationally fixed in the operational position of the barrel, but, engaging releasably into one another in the axial direction, for example, via a tooth system, and with the one part of the driver being rotationally fixedly connected or connected in any other way drive effectively to the barrel and the other part of the driver being coupled to the bolt (not shown). Such a lock can be formed analog to the lock in accordance with FIG. 3, with the region 61 only not being formed as a predetermined breaking point, but rather releasably engage being formed as a region in which the two parts of the driver into one another in a drive effective manner.

It is essential for all the embodiments described above that, in the axial extension of the locking cylinder, a receiving space is formed which enables an axial movement of the locking cylinder or of the barrel into a sabotage position to disengage the drive effective coupling function between the barrel and at least one bolt.

The invention claimed is:

1. A lock comprising a lock housing in which a locking cylinder of the lock is arranged, a cylinder housing, a barrel rotatably mounted in the cylinder housing and a driver unit associated in a drive effective manner with the barrel, at least one bolt coupled to the barrel via the driver unit so that by rotating the barrel the at least one bolt is moveable from a locked position into a release position, wherein the lock housing has a receiving space in an axial extension of the locking cylinder with at least a part of the locking cylinder being displaced from an operational position into the receiving space to a sabotage position on the application of a predefined force in the axial direction on the locking cylinder in which the coupling of the at least one bolt to the barrel (33) is disabled.

2. A lock in accordance with claim 1, characterized in that fixing means (43) are provided, which in the operational position fix the locking cylinder (27) or of the part thereof, wherein the fixing means (43) can be overcome by the application of the predefined force from the locking cylinder (27) or of the part thereof.

3. A lock in accordance with claim 2, characterized in that the fixing means include at least one fixing lug (43) formed at the lock housing (15, 21) for the locking cylinder (27).

4. A lock in accordance with claim 2, characterized in that a fixation means inbeds a wall section for the barrel (33) at an axial end of the locking cylinder (27).

5. A lock in accordance with claim 1, characterized in that holding means (47) are provided, which in the operational position of the locking cylinder (27) or of the part thereof are arranged bordering the at least one bolt (19), with the holding means (47) being capable of being overcome by the at least one bolt (19) by the application of the predefined force.

6. A lock in accordance with claim 5, characterized in that the holding means include at least one holding lug (47) formed at the lock housing (15, 21) for the at least one bolt (19).

7. A lock in accordance with claim 2, characterized in that the fixing means (43) are formed to break should the predefined force be reached.

8. A lock in accordance with claim 1, characterized in that the lock housing (15, 21) includes retaining means (51), which are formed to hold the locking cylinder (27) or of the part thereof following their displacement in the sabotage position.

9. A lock in accordance with claim 8, characterized in that the retaining means are formed as a taper (51) of a cavity (41) of the lock housing (15, 21), into which the locking cylinder is placed in the operational position.

10. A lock in accordance with claim 1, characterized in that, the lock includes fixing means (49), which in the sabotage position of the locking cylinder (27) or of the part thereof prevent the at least one bolt (19) from a movement out of the locked position into the release position.

11. A lock in accordance with claim 1, characterized in that, in the sabotage position of the locking cylinder (27), the at least one bolt (19) is in operative connection with an abutment section (50) of the lock housing (15, 21), which blocks the at least one bolt (19) from a movement out of the locked position into the release position.

12. A lock in accordance with claim 1, characterized in that the bolt (19) is supported in the lock housing (15) in such a way, that upon moving the locking cylinder (27) or of the part thereof the at least one bolt (19) experiences a plastic deformation.

13. A lock in accordance with claim 1, characterized in that, in the sabotage position of the locking cylinder (27) or of the part thereof, a blocking section (63) of the locking cylinder (27) prevents the at least one bolt (19) from a movement out of the locked position into the release position.

14. A lock in accordance with claim 1, characterized in that, in the sabotage position of the locking cylinder (27) or of the part thereof, at least one associated coupling section of the driver unit (35) and at least one coupling section of the at least one bolt (19) are decoupled from one another.

15. A lock in accordance with claim 1, characterized in that, in the sabotage position, the drive effective relationship of the driver unit (35) and the barrel (33) is disengaged.

16. A lock in accordance with claim 1, characterized in that, in the direction of the longitudinal axis (29) of the locking cylinder (27), the receiving space (45) has a smaller extent than the locking cylinder (27).

17. A lock in accordance with claim 1, characterized in that the driver unit (35) is arranged in the axial extension of the barrel (33) and is coaxially arranged relative to the barrel (33).

18. A lock in accordance with claim 1, characterized in that the at least one bolt (19) is pivotally connected to the driver unit (35).

19. A lock in accordance with claim 1, characterized in that the at least one bolt comprises two bolts (19), with the driver unit (35) having two eccentrically arranged driver cams (37), at each of which one of the bolts (19) is pivotally disposed.

20. A lock in accordance with claim 1, characterized in that, in the operational position of the locking cylinder (27) or of the part thereof, the at least one bolt (19) is prestressed in the direction of the driver unit (35) and is in contact with an eccentric peripheral contact region (59) of the driver unit (35), with respect to the axis of rotation of the driver unit (35).

21. A lock in accordance with claim 1, characterized in that the direction of movement of the at least one bolt (19) extends perpendicular to the longitudinal axis of the locking cylinder (27).

22. A lock in accordance with claim 1, characterized in that the at least one bolt (19) is formed as a bolt plate at its end adjacent to the driver unit (35) and as a bolt block (25) at its end facing opposite to the barrel.

23. A lock in accordance with claim 5, characterized in that the holding means (47) are designed to break should the predefined force be reached.

24. A lock in accordance with claim 1, characterized in that the at least one bolt (19) is formed as a bolt plate at its end adjacent to the driver unit (35) or as a bolt block (25) at its end facing the locking region.

* * * * *